US008241004B2

(12) United States Patent
Strother

(10) Patent No.: US 8,241,004 B2
(45) Date of Patent: Aug. 14, 2012

(54) COMPONENT STRUCTURE

(75) Inventor: Oliver Michael Strother, Bristol (GB)

(73) Assignee: Rolls-Royce, PLC, London (GB)

( * ) Notice: Subject to any disclaimer, the term of this patent is extended or adjusted under 35 U.S.C. 154(b) by 479 days.

(21) Appl. No.: 12/453,435

(22) Filed: May 11, 2009

(65) Prior Publication Data

US 2009/0304517 A1 Dec. 10, 2009

(30) Foreign Application Priority Data

May 15, 2008 (GB) ..... 0808840.3

(51) Int. Cl.
*B63H 1/26* (2006.01)

(52) U.S. Cl. ..... 416/232; 416/233; 416/229 A; 416/241 A; 416/241 R

(58) Field of Classification Search ..... 416/232, 416/233, 229 A, 241 A, 241 R
See application file for complete search history.

(56) References Cited

U.S. PATENT DOCUMENTS

| | | | | |
|---|---|---|---|---|
| 2,202,014 | A * | 5/1940 | Lougheed | 416/230 |
| 3,111,747 | A | 11/1963 | Johnson | |
| 3,927,817 | A | 12/1975 | Hamilton et al. | |
| 4,217,397 | A | 8/1980 | Hayase et al. | |
| 4,292,375 | A | 9/1981 | Ko | |
| 4,304,821 | A | 12/1981 | Hayase et al. | |
| 4,522,860 | A | 6/1985 | Scott et al. | |
| 4,655,014 | A | 4/1987 | Krecke | |
| 4,811,890 | A | 3/1989 | Dowling et al. | |
| 4,882,823 | A | 11/1989 | Weisert et al. | |
| 5,143,276 | A | 9/1992 | Mansbridge et al. | |
| 5,240,376 | A | 8/1993 | Velicki | |
| 5,253,419 | A | 10/1993 | Collot et al. | |
| 5,323,953 | A | 6/1994 | Adderley et al. | |
| 5,330,092 | A | 7/1994 | Gregg et al. | |
| 5,384,959 | A | 1/1995 | Velicki | |
| 5,419,039 | A | 5/1995 | Auxier et al. | |
| 5,469,618 | A | 11/1995 | Lemonds et al. | |
| 5,534,354 | A | 7/1996 | Gregg et al. | |
| 5,544,805 | A | 8/1996 | Alassoeur et al. | |
| 5,570,552 | A | 11/1996 | Nehring | |
| 5,692,881 | A | 12/1997 | Leibrfied | |
| 5,723,225 | A | 3/1998 | Yasui et al. | |

(Continued)

FOREIGN PATENT DOCUMENTS

EP 0 130 583 A2 1/1985

(Continued)

OTHER PUBLICATIONS

Sep. 2, 2009 European Search Report issued in European Application No. 09 25 1341.

(Continued)

*Primary Examiner* — Michelle Mandala
(74) *Attorney, Agent, or Firm* — Oliff & Berridge, PLC

(57) ABSTRACT

Within hollow structures, such as blade structures in a gas turbine engine, traditionally rigid girdered reinforcement has been utilised to define structure and shape. Such rigid definition can inhibit utilisation of damping fillers within the hollow structure. By providing a web former comprising spaced bond areas suspended upon angled interconnecting membranes a hollow structure is achieved which is flexible and can be used in conjunction with a damping filler to achieve desired performance. The web former supports skins defining the shape and takes some load such that the damping filler does not separate within the hollow structure.

17 Claims, 4 Drawing Sheets

U.S. PATENT DOCUMENTS

| | | | | |
|---|---|---|---|---|
| 5,826,332 | A | 10/1998 | Bichon et al. | |
| 5,881,459 | A | 3/1999 | Yasui | |
| 5,941,446 | A | 8/1999 | Yasui | |
| 6,039,542 | A | 3/2000 | Schilling et al. | |
| 6,139,278 | A | 10/2000 | Mowbray et al. | |
| 6,224,341 | B1 | 5/2001 | Fricke | |
| 6,331,217 | B1 | 12/2001 | Burke et al. | |
| 6,419,146 | B1 | 7/2002 | Buldhaupt et al. | |
| 6,467,168 | B2 | 10/2002 | Wallis | |
| 6,669,447 | B2 | 12/2003 | Norris et al. | |
| 6,720,087 | B2 * | 4/2004 | Fried et al. | 428/614 |
| 6,893,211 | B1 | 5/2005 | Eibl et al. | |
| 7,025,568 | B2 | 4/2006 | Jones | |
| 7,144,222 | B2 | 12/2006 | Lanni et al. | |
| 7,247,003 | B2 * | 7/2007 | Burke et al. | 416/229 R |
| 7,311,500 | B2 | 12/2007 | Rongong et al. | |
| 7,431,197 | B2 | 10/2008 | Franchet et al. | |
| 7,470,114 | B2 * | 12/2008 | Bonnet | 416/226 |
| 7,753,654 | B2 | 7/2010 | Read et al. | |
| 2002/0014101 | A1 | 2/2002 | Yajima | |
| 2003/0136815 | A1 | 7/2003 | Debaisieux et al. | |
| 2003/0156942 | A1 | 8/2003 | Villhard | |
| 2003/0164255 | A1 | 9/2003 | Borroni-Bird et al. | |
| 2004/0018091 | A1 | 1/2004 | Rongong et al. | |
| 2004/0191069 | A1 | 9/2004 | Motherwell | |
| 2006/0066133 | A1 | 3/2006 | Ueno et al. | |
| 2006/0255098 | A1 | 11/2006 | Runyan | |
| 2007/0065291 | A1 | 3/2007 | Karafillis | |
| 2007/0243070 | A1 | 10/2007 | Matheny | |
| 2007/0243408 | A1 | 10/2007 | Straza | |
| 2009/0057488 | A1 | 3/2009 | Goldfinch et al. | |
| 2009/0057489 | A1 | 3/2009 | Goldfinch et al. | |
| 2009/0057718 | A1 | 3/2009 | Suvorov et al. | |
| 2009/0060718 | A1 | 3/2009 | Goldfrinch et al. | |
| 2009/0304517 | A1 | 12/2009 | Strother | |
| 2010/0021693 | A1 | 1/2010 | Goldfinch et al. | |
| 2010/0186215 | A1 | 7/2010 | Jones et al. | |

FOREIGN PATENT DOCUMENTS

| | | | |
|---|---|---|---|
| EP | 0 181 203 | A2 | 5/1986 |
| EP | 0 209 867 | A2 | 1/1987 |
| EP | 0 358 523 | A1 | 3/1990 |
| EP | 0 418 179 | A1 | 3/1991 |
| EP | 0 469 221 | A1 | 2/1992 |
| EP | 0 354 631 | B1 | 6/1992 |
| EP | 0 500 458 | A1 | 8/1992 |
| EP | 0 520 827 | A2 | 12/1992 |
| EP | 0 527 564 | A1 | 2/1993 |
| EP | 0 549 172 | A1 | 6/1993 |
| EP | 0 555 534 | A2 | 8/1993 |
| EP | 0 582 795 | A1 | 2/1994 |
| EP | 0 594 885 | A1 | 5/1994 |
| EP | 0 765 711 | A1 | 4/1997 |
| EP | 0 716 273 | B1 | 3/1998 |
| EP | 0 926 312 | A2 | 6/1999 |
| EP | 1 013 355 | A2 | 6/2000 |
| EP | 1 085 288 | A1 | 3/2001 |
| EP | 0 594 886 | B1 | 7/2001 |
| EP | 1 160 752 | A1 | 12/2001 |
| EP | 1 184 768 | A2 | 3/2002 |
| EP | 1 024 330 | B1 | 11/2002 |
| EP | 0 886 813 | B1 | 1/2003 |
| EP | 1 327 489 | A1 | 7/2003 |
| EP | 1 355 212 | A1 | 10/2003 |
| EP | 1 433 993 | A1 | 6/2004 |
| EP | 1 460 347 | A1 | 9/2004 |
| EP | 1 460 507 | A2 | 9/2004 |
| EP | 1 466 692 | A1 | 10/2004 |
| EP | 1 491 980 | A2 | 12/2004 |
| EP | 1 541 953 | A1 | 6/2005 |
| EP | 1 561 901 | A2 | 8/2005 |
| EP | 1 160 640 | B1 | 2/2006 |
| EP | 1 653 165 | A1 | 5/2006 |
| EP | 1 811 129 | A2 | 7/2007 |
| EP | 2 014 384 | A1 | 1/2009 |
| EP | 2 014 386 | A1 | 1/2009 |
| EP | 2 014 387 | A1 | 1/2009 |
| EP | 2 014 388 | A1 | 1/2009 |
| EP | 2 014 869 | A1 | 1/2009 |
| EP | 2 223 766 | A1 | 9/2010 |
| GB | 842937 | A | 7/1960 |
| GB | 1 367 958 | A | 9/1974 |
| GB | 1 437 510 | A | 5/1976 |
| GB | 2 124 520 | A | 2/1984 |
| GB | 2 154 287 | A | 9/1985 |
| GB | 1 284 867 | A | 7/1987 |
| GB | 2 193 306 | A | 2/1988 |
| GB | 2 198 264 | A | 6/1988 |
| GB | 2 202 619 | A | 9/1988 |
| GB | 2 206 685 | A | 1/1989 |
| GB | 2 211 593 | A | 7/1989 |
| GB | 2 228 069 | A | 8/1990 |
| GB | 2 249 615 | A | 5/1992 |
| GB | 2 251 063 | A | 6/1992 |
| GB | 2 261 032 | A | 5/1993 |
| GB | 2 298 265 | A | 8/1996 |
| GB | 2 305 720 | A | 4/1997 |
| GB | 2 360 070 | A | 9/2001 |
| GB | 2 371 095 | A | 7/2002 |
| GB | 2 387 669 | A | 10/2003 |
| GB | 2 391 270 | A | 2/2004 |
| GB | 2 393 498 | A | 3/2004 |
| GB | 2 397 855 | A | 8/2004 |
| GB | 2 401 407 | A | 11/2004 |
| GB | 2 402 716 | A | 12/2004 |
| GB | 2 408 295 | A | 5/2005 |
| GB | 2 411 462 | A | 8/2005 |
| GB | 2 416 228 | A | 1/2006 |
| GB | 2 450 934 | A | 1/2009 |
| GB | 2 450 935 | A | 1/2009 |
| JP | A-2008-133825 | | 6/2008 |
| WO | WO 97/27045 | A2 | 7/1997 |
| WO | WO 00/70271 | A1 | 11/2000 |
| WO | WO 01/56332 | A1 | 8/2001 |
| WO | WO 01/82018 | A2 | 11/2001 |
| WO | WO 02/48615 | A2 | 6/2002 |
| WO | WO 03/025469 | A1 | 3/2003 |
| WO | WO 03/042607 | A1 | 5/2003 |
| WO | WO 03/093916 | A2 | 11/2003 |
| WO | WO 2004/102077 | A1 | 11/2004 |
| WO | WO 2005/022953 | A1 | 3/2005 |
| WO | WO 2005/045326 | A1 | 5/2005 |
| WO | WO 2005/067619 | A2 | 7/2005 |
| WO | WO 2005/069820 | A2 | 8/2005 |
| WO | WO 2005/071510 | A1 | 8/2005 |

OTHER PUBLICATIONS

Dec. 14, 2010 Search Report issued in British Application No. GB1020063.2.

Jul. 28, 2009 Search Report issued in British Patent Application No. 0907004.6.

Jul. 27, 2010 Search Report issued in European Patent Application No. 10 15 7495.2.

Jan. 19, 2010 Search Report issued in British Patent Application No. 0916687.7.

May 19, 2010 European Search Report issued in related European Patent Application No. 09252779.5 (with Abstract).

May 5, 2009 British Search Report issued in related British Patent Application No. GB0901235.2.

Mar. 18, 2009 British Search Report issued in British Patent Application No. GB0901318.6.

Oct. 7, 2008 European Search Report issued in European Patent Application No. 08 01 1077.

Oct. 20, 2008 European Search Report issued in European Patent Application No. 08 01 1078.

Oct. 21, 2008 European Search Report issued in European Patent Application No. 08 01 1079.

Dec. 7, 2010 Search Report issued in British Application No. GB1013305.6.

Sep. 2, 2010 Search Report issued in British Application No. GB1009216.1.

Sep. 15, 2009 Search Report issued in British Application No. GB0911416.6.

May 11, 2011 Partial European Search Report issued in European Application No. 10 16 5255.
Sep. 22, 2008 Search Report issued in British Application No. GB0808840.3.
Aug. 28, 2007 Search Report issued in British Application No. GB0713700.3.
Sep. 16, 2008 Search Report issued in British Application No. GB0813539.4.
Mar. 7, 2008 Search Report issued in British Application No. GB0713699.7.
Oct. 12, 2007 Search Report issued in British Application No. GB0713699.7.
Jul. 26, 2011 Office Action issued in U.S. Appl. No. 12/453,762.
Sep. 12, 2011 Office Action issued in U.S. Appl. No. 12/453,762.
Dec. 21, 2011 Notice of Allowance issued in U.S. Appl. No. 12/453,762.
Jul. 1, 2011 Office Action issued in U.S. Appl. No. 12/216,503.
Dec. 27, 2011 Notice of Allowance issued in U.S. Appl. No. 12/216,503.
Feb. 25, 2011 Office Action issued in U.S. Appl. No. 12/216,505.
Jun. 2, 2011 Office Action issued in U.S. Appl. No. 12/216,505.
Nov. 23, 2011 Office Action issued in U.S. Appl. No. 12/216,505.
Feb. 3, 2011 Office Action issued in U.S. Appl. No. 12/216,497.
Jul. 20, 2011 Office Action issued in U.S. Appl. No. 12/216,497.
Mar. 9, 2011 Notice of Allowance issued in U.S. Appl. No. 12/216,502.
Dec. 6, 2010 Office Action issued in U.S. Appl. No. 12/216,502.
U.S. Appl. No. 13/299,671 in the name of Strother, filed Nov. 18, 2011.
U.S. Appl. No. 12/654,504 in the name of Jones et al., filed Dec. 22, 2009.
U.S. Appl. No. 12/645,211 in the name of Strother, filed Dec. 14, 2009.
U.S. Appl. No. 12/844,215 in the name of Harron, filed Jul. 27, 2010.
U.S. Appl. No. 12/730,641 in the name of Strother, filed Mar. 24, 2010.
U.S. Appl. No. 12/216,503 in the name of Goldfinch et al, filed Jul. 7, 2008.
U.S. Appl. No. 13/186,850 in the name of Goldfinch et al, filed Jul. 20, 2011.
U.S. Appl. No. 13/114,382 in the name of Strother, filed May 24, 2010.
U.S. Appl. No. 12/453,762 in the name of Goldfinch, filed May 21, 2009.
U.S. Appl. No. 12/216,505 in the name of Strother, filed Jul. 7, 2008.
U.S. Appl. No. 12/796,231 in the name of Mason, filed Jun. 8, 2010.
-U.S. Appl. No. 13/008,323 in the name of Strother, filed Jan. 18, 2011.
U.S. Appl. No. 12/720,253 in the name of Strother, filed Mar. 9, 2010.
U.S. Appl. No. 12/720,351 in the name of Strother, filed Mar. 9, 2010.
U.S. Appl. No. 12/216,502 in the name of Goldfinch et al., filed Jul. 7, 2008.
U.S. Appl. No. 12/216,497 in the name of Goldfinch et al., filed Jul. 7, 2008.
Mar. 20, 2012 Office Action issued in U.S. Appl. No. 12/216,505.
Mar. 12, 2012 Notice of Allowance issued in U.S. Appl. No. 12/216,503.
Apr. 16, 2012 Office Action issued in U.S. Appl. No. 12/216,502.

* cited by examiner

COMPONENT STRUCTURE

The present invention relates to component structures, and more particularly to structures such as those utilised in gas turbine engines.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

In view of the above it will be appreciated that blades and in particular compressor blades within a gas turbine engine need to be sufficiently rigid to define a shape for function. In such circumstances the blades have tended to incorporate a reinforcing girder-like structure.

Such rigid structures including a girder core, and possibly a filling for damping, have tended not to be optimised to achieve best damping within the structure. It will be appreciated that a robust internal girder structure is rigid and so does not permit damping materials held within the cavity of the blade structure to operate effectively. Rigidity denies flexibility and therefore there may be additional problems with regard to cracking and early fatigue within the blade structure. The rigidity of the blade's structure prevents it transmitting loads in shear, which is the principal mechanism by which the damping medium operates.

A further disadvantage of rigid, girder-like structures is that they typically divide the internal space of the structure into a plurality of separate cavities. If a damping medium is to be used, each of these cavities must be separately filled with the damping medium, which greatly increases the time and cost to manufacture such structures.

If, by contrast, no internal structure is provided, all the radial loads on the blade in use must be carried by the outer skins, which must therefore be thicker and heavier. Also, there is nothing to prevent movement of the damping medium within the blade structure.

It is therefore an object of this invention to provide a component structure that will reduce, or preferably overcome, the disadvantages of known arrangements as described above.

In accordance with the invention there is provided a component structure as set out in the claims.

The invention will now be described, by way of example only, with reference to the accompanying drawings in which.

As indicated above, prior component structures such as those used in blades have not fully utilised damping materials and media in the structure; so it is desirable to provide some flexibility in the structure. However, that flexibility must not be at the expense of achieving adequate blade definition and shaping for function. The invention provides flexibility through use of a web former which presents a skin of a structure using bond areas suspended upon a membrane. Thus, in comparison with prior girder structures, the presentation and support of the skin forming the blade structure is discontiguous and suspended on the membrane.

The web former can be made from any appropriate material, and comprises a single layer or multiple layers, normally of perforated metallic or non-metallic web. Generally, the web former is secured to at least one skin through diffusion bonding, or possibly by an appropriate adhesive.

Figure 1:
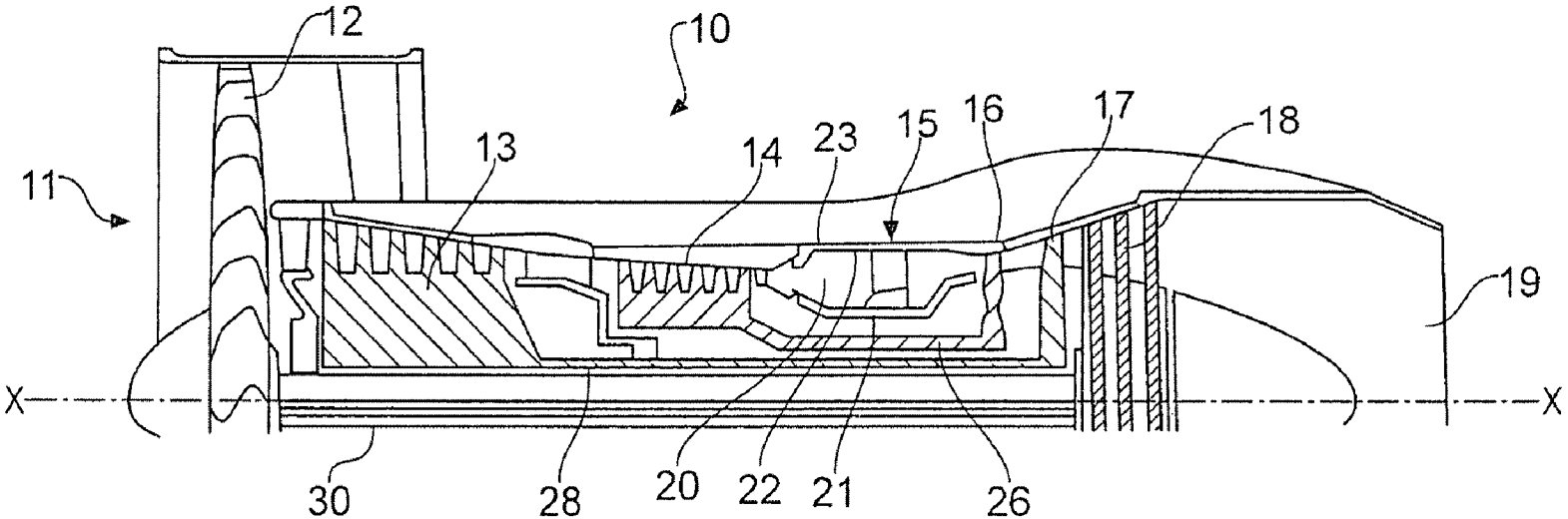
FIG. 1 is a cross-sectional side view of a gas turbine engine.
Figure 2:
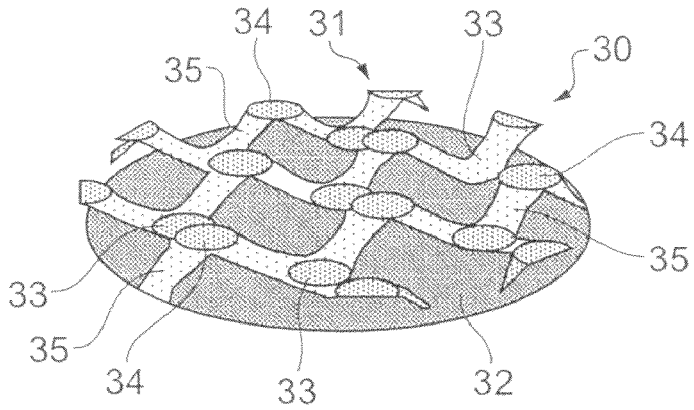
FIG. 2 is a schematic perspective view of a web former associated with a skin in accordance with the invention.

FIG. 2 provides a front perspective view of a first configuration of a blade structure 30, in accordance with of the invention. It will be appreciated that normally a skin or layer will be provided either side of a web former 31. In FIG. 2, only a lower skin 32 is depicted for clarity, the upper skin being removed. The web former 31 is therefore secured upon the lower skin 32 through bond areas 33. It will be appreciated that alternate bond areas 34 would be associated with the upper layer or skin (not shown).

The web former 31 has membrane sections 35 which angularly extend between the bond areas 33, 34. In such circumstances, the bond areas 33, 34 are effectively suspended upon the web membranes 35, extending between them. In such circumstances, the bond areas 33, 34 are laterally displaced relative to each other. The degree of such lateral spacing is dependent upon the membranes 35, and therefore it will be appreciated that the web former 31—through appropriate shaping in terms of depth, angle and size of membranes 35—along with bond areas 33, 34 can define a shape for skins 32 or layers as required.

Normally, at least one of the bond areas 33, 34 is secured to a skin 32; whilst the other skin may simply be offset by abutment of a bond pad with the skins to provide even greater flexibility in the structural parts of the blade structure 30, and to utilise the damping capabilities of the damping material located about and embedding the web former 31.

As illustrated in FIG. 2, a blade structure 30 can be created by a single web former extending between opposed skins 32.

Figure 3:
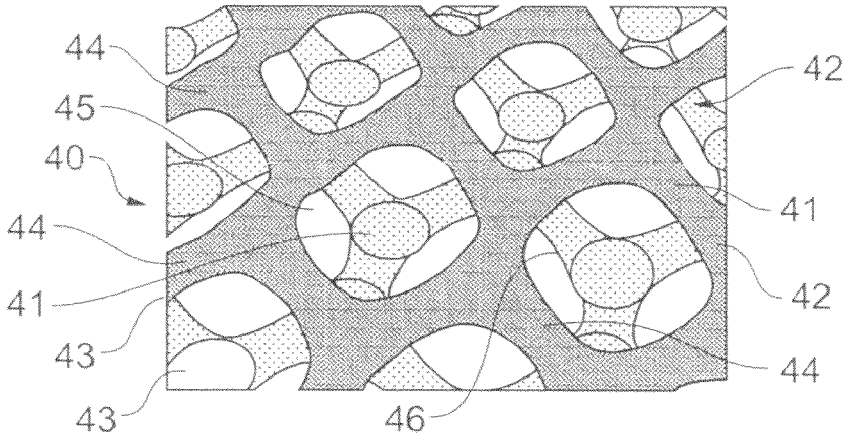
FIG. 3 is a schematic perspective view of interlocking web formers in accordance with the invention.

Such a structure 30 may be weak, particularly in the interstices between bond areas 33, 34 either side of the structure 30. In such circumstances, as depicted in FIG. 3, a web former combination 40 can comprise interengaging or locking web formers 41, 42 respectively comprising bond areas 43, 44 with membranes extending between them. The bond areas 43 extend into gaps 45 in web 41 whilst bond areas 44 extend into gaps 46 in web former 42. As previously, the membranes of the respective web formers 41, 42 are angularly presented such that the respective bond areas 43, 44 are laterally displaced relative to each other through the gaps 45, 46, to give shaping to define a blade structure comprising skins or layers upon which the bond areas 43, 44 are secured. It will be understood that, as previously, bond areas 43 of one web 42 may be secured to the skin on one side and simply abut to support the skin on the other side of the bond structure which is secured to the other bond areas 44 of the other web former 41. In this way, the structure 40—when secured to skins either side—provides a highly flexible but nevertheless robust presentation of the blade structure. The flexibility allows embedded damping material about the web formers 41, 42 to damp vibration and acoustics.

Figure 4:
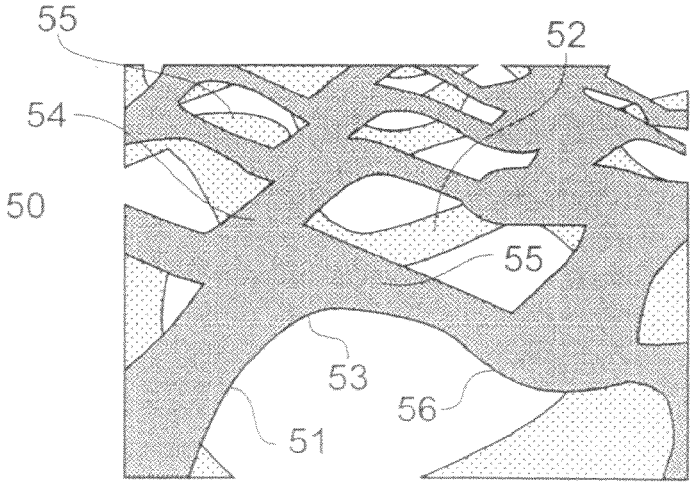
FIG. 4 is a schematic side perspective view of bonding between membranes of web formers in accordance with the invention.

It will be appreciated that the robustness of presentation and shaping of the bond structure in accordance with the invention depends, as indicated, upon the dimensions and angles of the membranes extending between bond areas. There will be a limit to the capabilities of such configurations. Thus, to achieve appropriate or desired shaping, as depicted in FIG. 4, stacks of web formers in accordance with the invention may be utilised. In such circumstances a web former structure 50 comprises a lower web former 51 and an upper web former 52 with membranes and respective bond areas 53, 54 extending to engage with each other. These bond areas 53, 54 are secured together in order to create a stack of web formers 51, 52. Other bond areas 55, 56 of the respective formers 51, 52 are still utilised to engage, support and be bonded to skins in order to define an exterior blade structure in accordance with the invention. By using stacks of web formers in this way, thicker component structures can be produced.

Figure 5:
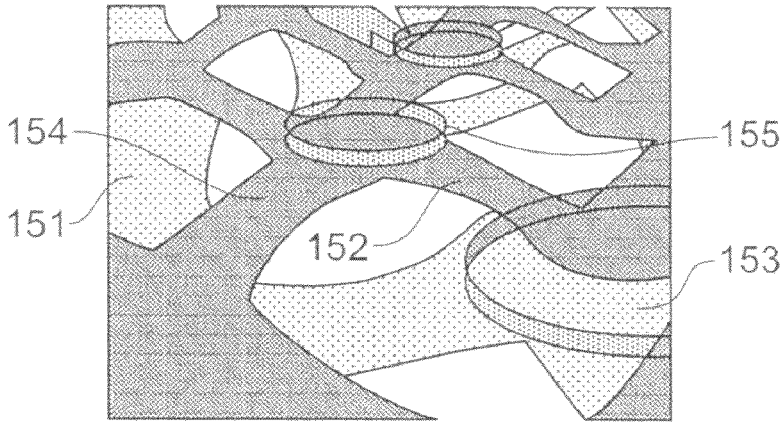
FIG. 5 is a side perspective view of web formers in accordance with the invention having a damping layer between them.

As indicated above, generally the web formers will be surrounded or embedded in a damping material. Thus, as the structure flexes the membranes will similarly flex to allow the damping material to absorb vibrations and acoustic noise. It is also possible to provide—either between the bonding areas in engagement with the skin, or between bonding areas engaging each other in stacks or web formers as depicted in FIG. 4—a layer of damping material 55. As depicted in FIG. 5, a general configuration of the blade structure is similar to that depicted in FIG. 3, with interlocking web formers 151, 152 with respective bond areas laterally displaced relative to each other to support and present skins in a shape desired for the blade structure. Each web former 151, 152, as indicated, presents bonding areas 153, 154, with the damping layer 155 between the bonding areas 153, 154 and the skin or between the areas 153, 154 themselves. In such circumstances the damping layer 155 will itself provide some flexibility for absorption of vibration etc.

Figure 6:
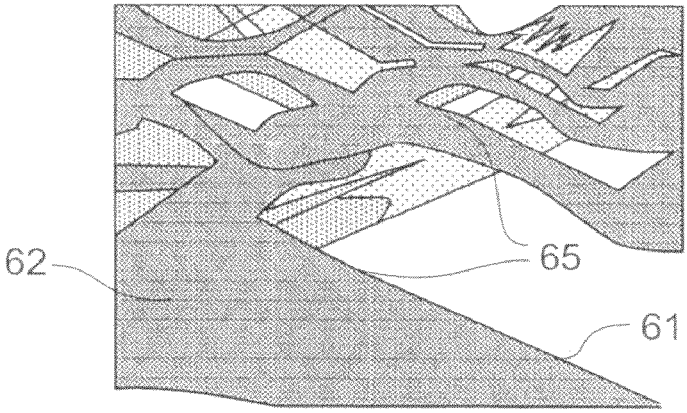
FIG. 6 is a schematic side view of web formers in a bond structure in accordance with the invention with a gap between membranes of the formers.

As indicated above, web formers in accordance with the invention are generally secured at least to one skin defining the shape for the blade structure. Thus, as depicted in FIG. 6, web formers can act as effective reinforcers—secured to one side of a skin but without interaction with a similar web former secured to the other side of the skin. In such circumstances, there is a gap 65 between web formers 61, 62. This gap, as previously, may be filled with a damping layer or may simply permit a limited amount of deformation before contact occurs between the web formers (in particular, membranes or bond areas of the web formers). Furthermore, when the web formers are surrounded and embedded within damping material, it will be appreciated that such damping material will enter between the opposing web formers and therefore provide damping of the web formers in deformation.

Figure 7:
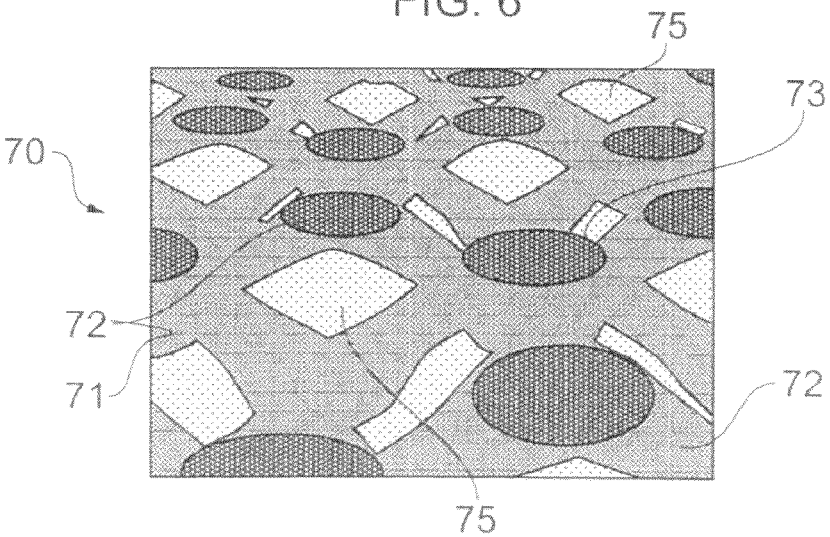
FIG. 7 is a schematic illustration showing web formers in accordance with the invention and a damping material.

FIG. 7 provides a further illustration of a blade structure incorporating interlocking web formers 71, 72 in the structure 70. Again the web formers 71, 72 extend through gaps in each others' mesh structure with respective bond areas 73, 74 appropriately positioned to enable at least support for a skin or to be bonded to that skin to define the blade structure in use. Between the interstices of the web formers 71, 72 a volume of visco-elastic damping material is located in areas 75, such that deformation of the web formers 71, 72 is against this visco-elastic damping material and therefore can absorb vibration etc.

Figure 8:
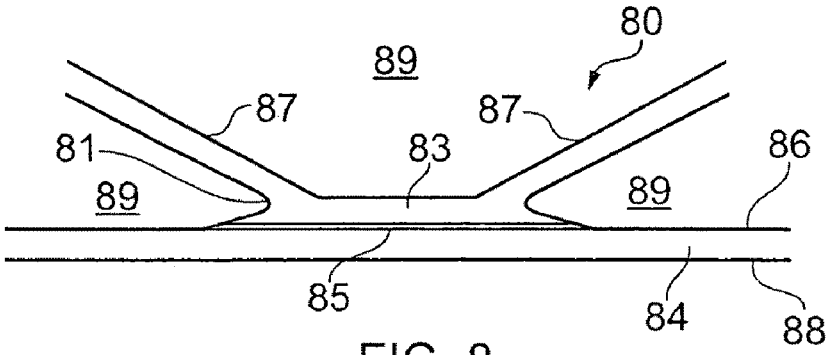
FIG. 8 is a schematic side view of a bond area locating a web former and in particular a membrane in accordance with the invention.

It will be appreciated that the invention depends upon the bonding areas providing anchors or support positions for the skin of the blade structure. Particularly where the bond areas are secured to the skin, care must be taken that the flexing of the associated web membranes does not overly stress the skin or the membrane itself. In such circumstances, as depicted in FIG. 8, at a bond site 85 for a bond area 83 to a skin 84 of a structure 80 in accordance with the invention it will be noted that a radial feature 81 is provided. This radial feature 81 reduces stress concentration at a junction between the bond area 83 and an inner surface 86 of the skin 84, as well as with membranes 87 extending away from the bond area 83. As indicated previously, through the provision of a web former comprising the membranes 87 and bond areas 83, presentation of the skin 84 is effectively suspended. In such circumstances, impacts upon an external surface 88 of the skin 84 can be absorbed by the membranes 87. It will also be understood that generally the membranes 87, as part of a web former in accordance with the invention, will be surrounded and embedded in areas 89 with a damping material to further enhance absorption of vibrations. It is by combining the suspension with the membranes 87 with the damping material that a good, consistent and robust component structure shape can be achieved, without the necessity of a rigid girder construction as with previous blade structures.

Figure 9:
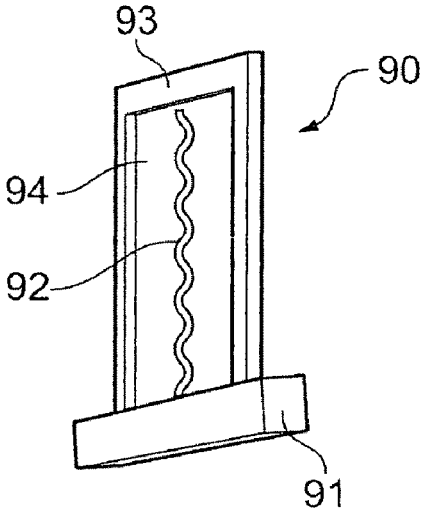
FIG. 9 is a schematic view of one alternative web former in accordance with the invention.

An alternative form of web former in accordance with the invention is to use an undulating strip or ribbon as depicted in FIG. 9. FIG. 9 schematically illustrates a blade structure 90 extending from a root 91. Only one undulating strip or ribbon 92 is shown extending from a root 91 end of the structure 90 to a tip end 93 in a space between a skin 94 and another skin (not shown) but usually there will be a number of undulating strips. Between the skin 94 and the other skin (not shown) a cavity is provided, supported and presented by the undulating strip or ribbon 92. Generally bends or folds in the strip or ribbon 92 are diffusion bonded to the skin 94 or other internal panels. Thus, once formed, the strip or ribbon 92 supports the blade structure with effective membranes between the bonded areas diffusion bonded to the respective skin or internal panels of the structure 90.

Figure 10:
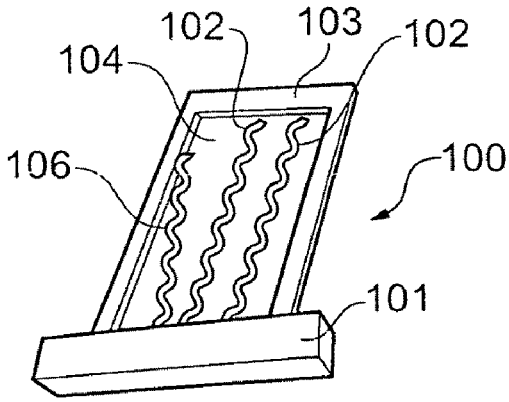
FIG. 10 is a schematic front perspective view of a plurality of web formers as depicted in FIG. 9 within a component structure.

Typically, in order to provide appropriate support over the full width and length of a blade structure it will be appreciated that a plurality of undulating strips or ribbons will be provided. Thus, as illustrated in FIG. 10, a blade structure 100 is shown extending from a root 101 with a cavity between a skin 104 and another skin (not shown). Ribbons 102 extend between the root 101 and a tip portion 103 and are generally parallel. However, it will be understood that the undulating strips of ribbons are provided for appropriate support within the structure 100 and therefore can be presented asymmetrical and non parallel to each other as depicted with regard to undulating strip 106.

The choice and position of the undulating strips 92, 102, 106 is dependent upon desired reinforcement and presentation utilisation, in association with damping materials, in a blade structure 90, 100. In such circumstances for appropriate shaping, as indicated, the undulating strips or ribbons act as web formers which are distributed appropriately to define the shape and can have different undulation spacing and sizing as appropriate.

In accordance with the invention, by positioning of the bonding areas along with the membranes between them, in terms of width, orientation and angle, adequacy of reinforcement whilst maintaining flexibility for use in combination with a damping material is achieved. The bond areas are effectively suspended upon the membranes between for flexibility. The distribution of the bond areas will be chosen dependent upon expected impact levels and other factors with regard to the component structure.

Figure 11:
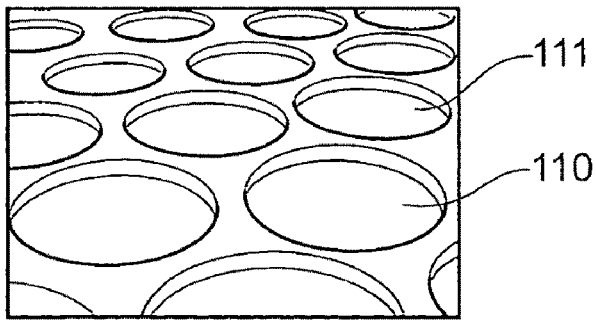
FIG. 11 illustrates a surface of a skin in accordance with the invention having key features to locate web formers.

As indicated, the positioning in the bond areas and their retention is important within a blade structure in accordance with the invention. There will be flexibility about the membranes between the bond areas, and therefore, as indicated above, radial bonding features 89 can be provided to avoid stressing. It will also be understood that a keyed association between skins or panels and the bonding area parts of the web may be provided. As depicted in FIG. 11 a tessellated textured surface is machined into an inner side of a panel or skin. The tessellated textured surface creates wells 110 in the panel skin surface which adjust its flexibility but also provide locations for engaging bond areas.

The area of the wells 110 will generally be smaller than that of the bond areas. In a typical embodiment, the area of the wells 110 will be about one-fifth the area of the bond areas.

Component structures in accordance with the invention may be formed from ready machined and shaped elements secured together as appropriate.

Alternatively, expansive plastic deformation techniques such as superplastic forming (SPF) can be utilised in order to create the blade structure. In this case, respective panels or skins of material will be presented with membrane former members in a flat state between them. The former members will be secured by appropriate techniques such as diffusion bonding or adhesive at the desired locations and the arrangement sealed about its edge. In such circumstances, once an expansive gas is presented between the skins or panels the arrangement will expand, with retention of the bonding at the bond areas, in order to create the web formers in accordance with the invention. The spacing and sizes of the bond areas, along with inflation pressure etc., will define the shape of the blade. The interconnecting membrane formers between the bond areas will then retain that component structure shape as required. In accordance with the invention, the shaped component structure will then be filled with a damping material. Alternatively, and possibly more conveniently, the damping material may be utilised as the means by which expansion of the component structure is achieved. In such circumstances, subsequent to the bonding process to secure the precursor web formers to the skins or panels and sealing as appropriate the damping material will be forcefully injected between the panels in order to create the structural shape in accordance with the invention. It will be understood that the elastic deformation process may be provided within a shaping mould to limit strain upon the bonding areas in engagement with the skin or panel.

With regard to ribbon or strip web formers, the membranes between the bonding areas will be used in conjunction with a damping filler to achieve a desired structural shaping. These ribbons may be straight or curved or otherwise configured to provide the desired structure. The ribbons can have a regular repeat spacing or non-regular spacing of waves and undulations as required to support and present the structure. The ribbon membranes, in association with a damping filler, will carry some radial load and therefore prevent separation and de-bonding by the damping filler from association with inner surfaces of the blade structure, as well as interlock the damping material as a mechanical feature within the structure. Similarly, a mesh web former will act two dimensionally in order to carry some radial load and therefore prevent separation of the damping filler within the bond structure, as well as interlock the damping filler within the structure for better integration.

By provision of a structure in accordance with the invention, it will be appreciated that the structure can flex in all directions by transmitting shear forces to the internal damping material. Prior blade structures, due to their more rigid girder reinforcement, tend not to flex evenly. By combining the benefits of a web former with a damper material, in accordance with the invention, improved overall performance is achieved without separation, as a result of the load being taken by the web former in combination with the damping filler. The damping medium is inhibited from separating from the structure subsequent to an impact or through normal operational stressing. The damping material is effectively mechanically keyed into the internal structure of the component and is therefore stabilised and bonded into that structure.

It will be appreciated that damping materials in accordance with the invention as well as the use of the web former has little weight penalty compared with an existing structure incorporating robust girders for shaping.

Although a component, and in particular a blade structure, has been utilised as an exemplary embodiment of a hollow structure in accordance with the invention, it will be appreciated that the combination of a web former and damper filler can also be utilised in other structures where greater flexibility for absorption, rather than absolute rigidity, will allow more efficient and effective operation. The invention may be utilised in any hollow structure which is internally supported and where there may be vibrations or impacts which could be beneficially dealt with by absorption rather than simply robustness. Some examples include within gas turbine engine fan blades, containment rings, outlet guide vanes and hollow static structures within the engine.

Modifications and alterations to the embodiments of the invention as described above will be appreciated by those skilled in the art. Thus, for example, typically the web formers will be formed from the same metal or non-metallic material, but it may be desirable to provide different response or mechanical properties in different parts of the structure through the materials or thicknesses of materials or treatments of materials used at those parts.

The skilled person would further recognise that instead of securing the web formers to the skins, at the bond areas using diffusion bonding or adhesive, as described above, they could equally well be secured using another suitable technique, such as brazing or welding.

In the embodiments shown in FIGS. 9 and 10, the strips or ribbons, if arranged at an angle to one another, may be interwoven to create a more complex internal structure.

The invention claimed is:

1. A component structure comprising:

a web former, including at least one material and bond areas suspended on a membrane;

a skin flexibly presented upon the web former to define a shape; and a damping material, wherein the damping material is separate from and different to the at least one material of the web former.

2. A structure as claimed in claim 1, wherein the component structure is a blade.

3. A structure as claimed in claim 1, and formed by superplastic forming.

4. A structure as claimed in claim 1, wherein the web former comprises a mesh with the membrane angularly orientated to present respective bond areas laterally displaced from each other.

5. A structure as claimed in claim 1, wherein the web former comprises a repeating tessellated pattern.

6. A structure as claimed in claim 1, wherein the web former comprises a plurality of undulating strips or ribbons.

7. A structure as claimed in claim 6 wherein the undulating strips or ribbons are substantially parallel to one another.

8. A structure as claimed in claim 1, wherein there is a plurality of web formers.

9. A structure as claimed in claim 8, wherein the web formers interlock with each other.

10. A structure as claimed in claim 1, wherein the structure incorporates an intermediate layer.

11. A structure as claimed in claim 10, wherein the web former is presented upon the intermediate layer.

12. A structure as claimed in claim 1, wherein the web former is embedded and/or surrounded with the damping material within the structure.

13. A structure as claimed in claim 1, wherein the bond areas have a radial edge to avoid stress concentration when secured to the skin.

14. A structure as claimed in claim 1, wherein the skin and/or web former incorporate key features to interlock with each other.

15. A structure as claimed in claim 1, wherein the damping material comprises a visco-elastic material.

16. A structure as claimed in claim 9, wherein the plurality of interlocking web formers comprise a repeating tessellated pattern.

17. A structure as claimed in claim 1, further comprising a damping material between at least one bonding area and the skin.

* * * * *